US006870114B2

(12) United States Patent
Cole et al.

(10) Patent No.: US 6,870,114 B2
(45) Date of Patent: Mar. 22, 2005

(54) METHOD AND APPARATUS FOR REMOVING AND REPLACING BULB OF PUSH-BUTTON TYPE ELECTRICAL SWITCH

(76) Inventors: Joseph W. Cole, 7104 Zia Campanile Ave., Las Vegas, NV (US) 89131; Oliver C. Mou, 9764 Trail Rider Dr., Las Vegas, NV (US) 89117

( * ) Notice: Subject to any disclaimer, the term of this patent is extended or adjusted under 35 U.S.C. 154(b) by 0 days.

(21) Appl. No.: 10/800,224

(22) Filed: Mar. 12, 2004

(65) Prior Publication Data

US 2004/0173445 A1 Sep. 9, 2004

Related U.S. Application Data

(63) Continuation-in-part of application No. 10/364,535, filed on Feb. 10, 2003, which is a continuation-in-part of application No. 09/804,701, filed on Mar. 12, 2001, now Pat. No. 6,590,176.

(51) Int. Cl.[7] ..... H01H 3/12

(52) U.S. Cl. ..... 200/341; 200/299; 81/53.11

(58) Field of Search ..... 200/341, 310, 200/296, 293, 299; 29/278; 81/51.11–51.15

(56) References Cited

U.S. PATENT DOCUMENTS

| | | | | | |
|---|---|---|---|---|---|
| 1,514,814 | A | * | 11/1924 | Allen | 81/53.11 |
| 3,740,501 | A | | 6/1973 | Kiessling et al. | |
| 3,895,205 | A | | 7/1975 | Tharp | |
| 3,983,348 | A | | 9/1976 | Kellogg | |
| 4,255,010 | A | * | 3/1981 | Jullien | 439/655 |
| 4,354,078 | A | | 10/1982 | Yoshimura | |
| 4,360,722 | A | | 11/1982 | Georgopulos | |
| 4,368,368 | A | | 1/1983 | Russenberger | |
| 4,419,555 | A | | 12/1983 | Kim | |
| 4,454,397 | A | | 6/1984 | Kim | |
| 4,585,914 | A | | 4/1986 | Ohashi et al. | |
| 4,590,342 | A | | 5/1986 | Schlegel | |
| 4,663,996 | A | * | 5/1987 | Grudgfield et al. | 81/53.11 |
| 4,733,036 | A | | 3/1988 | Koizumi et al. | |
| 4,852,925 | A | * | 8/1989 | Lodin | 294/2 |
| 4,871,890 | A | | 10/1989 | Herrera | |
| 5,044,058 | A | * | 9/1991 | Voss | 29/278 |
| 5,077,454 | A | | 12/1991 | Lorenzo | |
| 5,178,504 | A | | 1/1993 | Falchi | |
| 5,317,939 | A | * | 6/1994 | Marinescu | 81/53.11 |
| 5,401,925 | A | | 3/1995 | Sambar | |
| 5,543,594 | A | | 8/1996 | Romero-Herrera | |
| 5,809,850 | A | * | 9/1998 | Tickner | 81/53.11 |
| 6,066,816 | A | | 5/2000 | Benger | |
| 6,166,339 | A | | 12/2000 | Bechis | |
| 6,257,095 | B1 | * | 7/2001 | Yukness | 81/53.11 |

* cited by examiner

*Primary Examiner*—K. Lee
(74) *Attorney, Agent, or Firm*—Weide & Miller, Ltd.

(57) ABSTRACT

A tool for use in removing and replacing a bulb of a push-button type actuatable switch comprises a tool body having a first end defining a bulb-accepting opening. A plurality of tines surround at least a portion of the opening. When the tines are in a first position, the opening is sufficiently large to accept a bulb. When pressed inwardly, the tines reduce the size of the opening and engage a bulb located therein. Movement of a sleeve over the outside of the body presses the tines inwardly. In one embodiment, a flexible sleeve is located in the opening for gripping and protecting a bulb. A stop extends into the insert, limiting the extent to which a bulb may be pressed into the tool. An opposing end of the tool may include a prong or blade for engaging and removing a lens cover over a bulb.

17 Claims, 6 Drawing Sheets

METHOD AND APPARATUS FOR REMOVING AND REPLACING BULB OF PUSH-BUTTON TYPE ELECTRICAL SWITCH

RELATED APPLICATION DATA

This application is a continuation-in-part of U.S. application Ser. No. 10/364,535, filed Feb. 10, 2003, which is a continuation-in-part of U.S. application Ser. No. 09/804,701, filed Mar. 12, 2001, now U.S. Pat. No. 6,590,176.

FIELD OF THE INVENTION

The present invention relates to a tool for use in replacing the bulb of a push-button type electrical switch.

BACKGROUND OF THE INVENTION

Push-button type switches are utilized in thousands of applications. One common application for push-button switches is as an input device for a gaming machine. For example, a gaming machine may include a plurality of push-buttons permitting a user to indicate a input, such as to "hold" a card, place a "bet" of a monetary amount, "deal" cards or the like.

In many instances, gaming machines are located in areas of reduced illumination. The reduced illumination makes it easier for a player of the game to view information presented on a video display of the gaming machine. On the other hand, the reduced illumination makes it difficult for a player to observe other aspects of the gaming machine, such as the location of push-buttons. As a result, these gaming machine generally include a lamp for illuminating a push-button thereof.

A problem with these switches is that the life of the bulb or lamp is significantly less than that of the switch, forcing the operator to either replace the switch when a lamp burns out, or to replace burned out lamps several times during the life of a switch. Generally, however, it is very difficult to replace the lamp of such a switch. Generally, the entire switch must be removed from the housing to access the bulb, or at least a bottom portion of the switch must be access to access the bulb. This may require access to the interior of the gaming or other machine.

An improved system for removing and replacing lamps associated with such push-button switches is desired.

SUMMARY OF THE INVENTION

The present invention is lamp or bulb removal tool for use in removing and replacing a lamp of a push-button switch. The tool has a first end which defines a bulb-accepting opening. A plurality of tines surround at least a portion of the opening. The tines are movable. In a first position, the tines are preferably biased outwardly and the opening is sufficiently large to accept a bulb therein. In a second position, the tines are pressed inwardly, reducing the size of the opening and engaging a bulb therein.

In one embodiment, a slider or sleeve is mounted on the tool. In a first position, the slider is retracted from the tines, allowing them to be biased outwardly. In a second position, the slider is positioned over the tines, pressing them inwardly.

In a preferred embodiment, a cushioning insert is located in the bulb-accepting opening. The insert defines an opening or passage for accepting the bulb. When the tines are pressed inwardly, the insert is compressed, gripping the bulb tightly.

A stop extends into the insert. The stop limits the travel of the bulb into the insert.

In use, the end of the tool is placed over a bulb to be removed. When the tines are in their first or outward position, the tool may be lowered onto or over the bulb. The distance by which the tool may be placed over the bulb may be limited by the stop.

To remove the bulb, the tines are pressed inwardly, such as by moving the slider downwardly along the body over the tines. As the tines move inwardly, they engage the bulb or compress the insert (when one exists) against the bulb. Upward movement of the tool then causes the bulb to be extracted from its socket. When the tines are released, the bulb may easily be removed from the tool.

A replacement bulb may be located in the socket in reverse sequence.

In one embodiment, the lamp removal tool is specifically configured for use in removing a lamp of a push-button switch having a removable lens cap covering the lamp. In one embodiment, the second end of the tool has a prong or blade extending therefrom. The end of the head is engaged against a bottom edge of the lens cap or a slot formed therein. Upward pressure with the head causes the lens cap to disengage from the body of the push-button switch, permitting access to the bulb beneath.

Further objects, features, and advantages of the present invention over the prior art will become apparent from the detailed description of the drawings which follows, when considered with the attached figures.

DESCRIPTION OF THE DRAWINGS

FIG. 3(*b*) is a perspective view of the body of the push-button electrical switch looking in a direction from a bottom end towards a top end thereof;

DETAILED DESCRIPTION OF THE INVENTION

The invention is a method and apparatus for removing and replacing the bulb or lamp of a push-button type electrical switch. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is tool which is useful in replacing the bulb of a push-button type electrical switch. Such a switch may have a variety of configurations. In one embodiment, the switch includes a push-button for actuating an electrical switch. The push-button electrical switch has a bulb or lamp for illuminating a portion of a body or housing of the push-button electrical switch.

Figure 1:
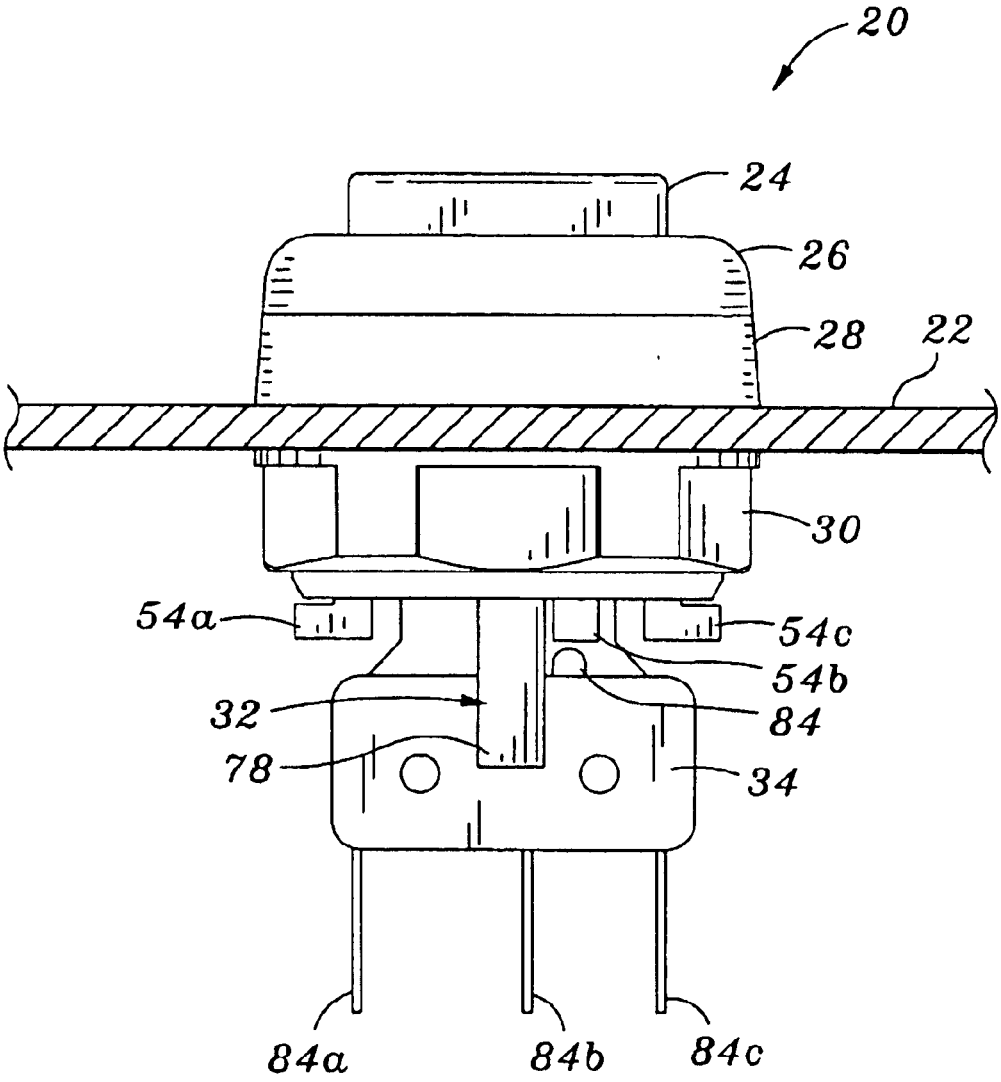
FIG. 1 is a side view of a push-button electrical switch of the invention mounted to a support structure in the form of a gaming machine housing.

A push-button electrical switch 20 of the type the tool of the invention is useful with will first be described generally with reference to FIG. 1. As illustrated, the push-button electrical switch 20 may be mounted to a support structure. As illustrated, the push-button electrical switch 20 is mounted to a support structure, such as a panel or housing 22 of a gaming machine. In general, the push-button electrical switch 20 includes a push-button lens cap 24 extending from a top portion or end of a button body or housing 26. The body or switch includes an adapter 28 and lock nut 30. As illustrated, the adapter 28 and lock nut 30 are associated with an exterior portion of the body 26. The adapter 28 may be formed integral with the body 26. A lamp/switch mount 32 is connected to the body 26 and extends from a bottom portion or end thereof generally opposite the push-button lens cap 24. An electrical switch 34 is connected to the lamp/switch mount 32.

In the arrangement illustrated, the housing 22 comprises a metal panel forming a portion of a body or housing of the gaming machine. The housing 22 has an aperture therethrough. Preferably, the body 26 extends through the aperture. The aperture is larger than the portion of the body 26 which extends therethrough, but is smaller in dimension than the adapter 28. The adapter 28 is positioned over the body 26 adjacent a top side of the housing 22, obscuring the aperture through which the body extends. The lock nut 30 is affixed to the body 26 from the bottom side of the housing 22. In this manner, the housing 22 is positioned between the adapter 28 and the lock nut 30, securing the push-button electrical switch 20 to the housing 22.

As detailed below, the push-button lens cap 24 extends outwardly from the body 26 for engagement by a user thereof, such as by a player of the gaming machine. When depressed or pushed by a user, the push-button lens cap 24 is arranged to activate/actuate the electrical switch 34. Leads extend from the electrical switch 34, and wires may be connected to the leads and extend to another device, whereby the signal from the electrical switch 34 is used as an input to that device.

Figure 2:
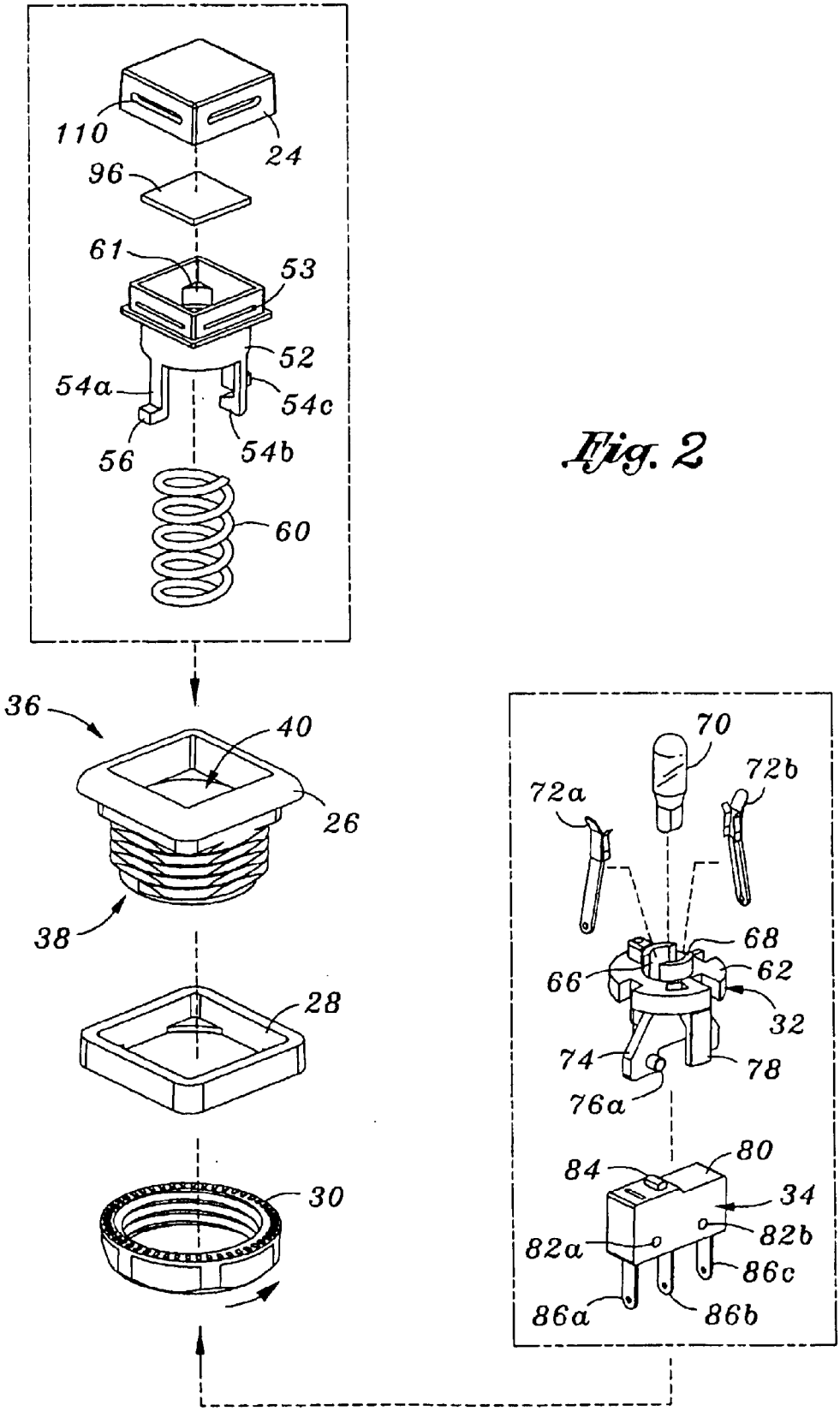
FIG. 2 is an exploded view of the push-button electrical switch illustrated in FIG. 1.

The components and construction of the push-button electrical switch 20 will now be described in detail. As illustrated in FIG. 2, the body 26 serves a supporting/housing function and includes a wall having inner and outer surfaces. In one embodiment, the body 26 is generally tubular and has a top or proximal end 36 and a bottom or distal end 38. A passage 40 extends through the body 26. As illustrated, at its top end 36, the body 26 is generally square, thus defining a generally square periphery of the passage 40. The body 26 may have a variety of other shapes at this location, such as round or rectangular. Preferably, the bottom end of 38 of the body 26 is generally cylindrical, thus defining a generally circular periphery of the passage 40 at that location.

In one or more embodiments, an outer surface of the body 26 is threaded at its bottom end 38. The threads extend upwardly towards the top end 36. The threads are adapted to accept mating threads on the lock nut 30.

Figure 3A:
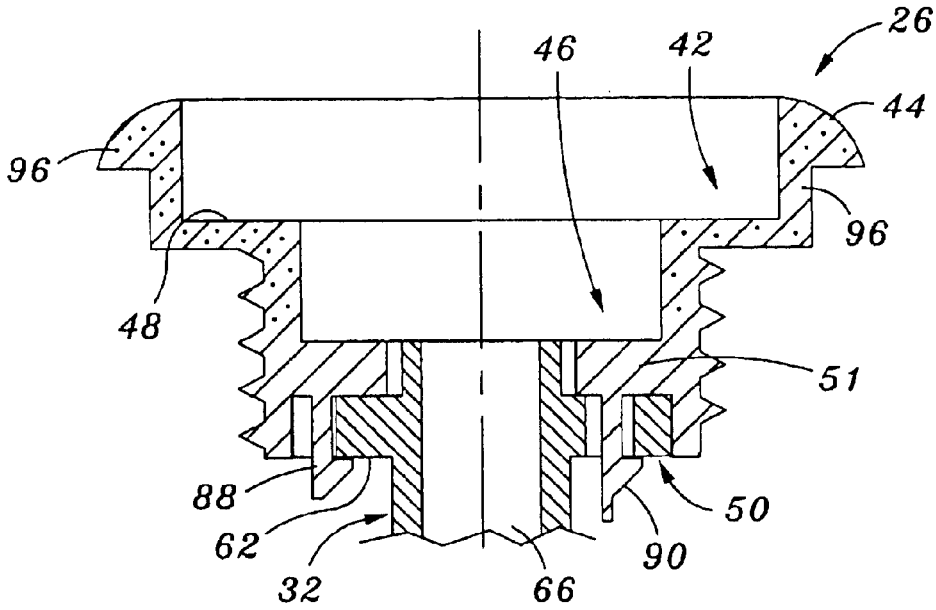
FIG. 3(*a*) is a cross-sectional view of a body of the push-button electrical switch illustrated in FIG. 1 along with a portion of an engaged lamp/switch mount connected thereto.
Figure 3B:
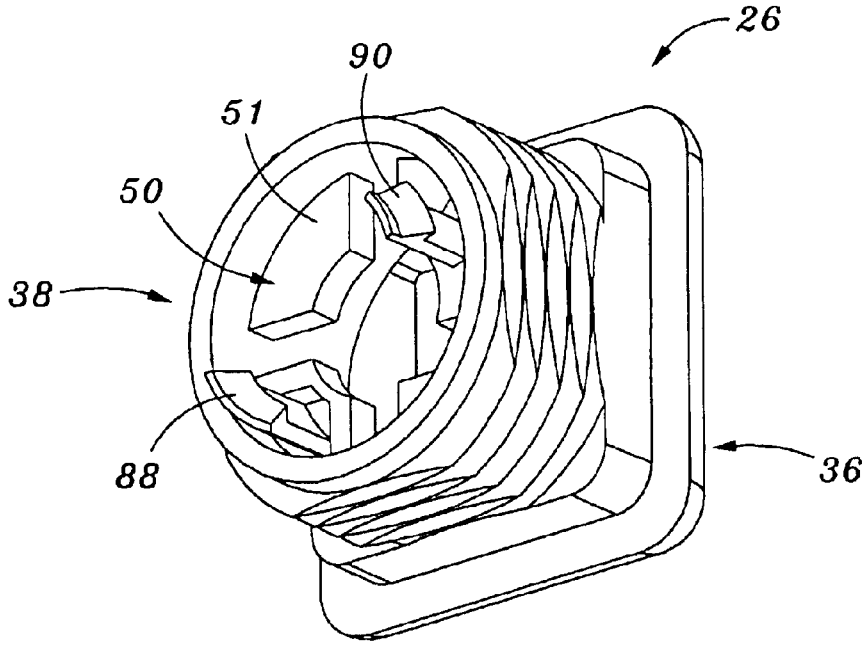

Referring to FIGS. 3(*a*) and 3(*b*), the body 26 defines an upper cavity 42 for accepting at least a portion of the push-button lens cap 24. The upper cavity 42 forms a portion of the passage 40 through the body 26. As illustrated, when the push-button lens cap 24 is generally square in peripheral shape, so is the upper cavity 42. As described above, the body 26 defines a periphery around the upper cavity 42 which is also generally square. As illustrated, the body 26 includes an outwardly extending flange 44 in this location. As noted above, the push-button lens cap 24 may be other than square, in which case the body 26 at this location is as well, for example round or rectangular.

A middle cavity 46 is positioned below the upper cavity 42 and also forms a portion of the passage 40. The middle cavity 46 is preferably cylindrical in shape, and has a diameter which is less than the maximum dimension of the upper cavity 42. As a result of the change in size and shape between the upper and middle cavities 42,46, a ledge 48 is defined. As detailed below, the ledge 48 serves as a stop to limit the travel of the push-button lens cap 24 downwardly into the body 26, and serves as a support for a spring.

A lower cavity 50 is positioned below the middle cavity 46 and also forms a portion of the passage 40. The lower cavity 50 is also preferably generally cylindrical in shape. As illustrated, a stop extends inwardly dividing at least a portion of the middle and lower cavities 46,50. Referring to FIG. 3(*b*), the stop comprises four wall or stop segments 51.

As described above, a push-button lens cap 24 is associated with the body 26, and preferably is located at the top end 36 thereof. At least a portion of the push-button lens cap 24 is adapted to extend from the top end 36 of the body 26 for engagement by a user. Referring to FIG. 2, the push-button lens cap 24 comprises a generally square member having a top surface and one or more sides or members extending downwardly therefrom. The push-button lens cap 24 may have a variety of other shapes, including rectangular and circular.

The push-button lens cap 24 is associated with an actuator 52. The actuator 52 has a first end shaped to accept the push-button lens cap 24 there over. When the push-button lens cap 24 is square, preferably so is the first end of the actuator. Likewise, when the push-button lens cap 24 has other shapes such as rectangular or circular, the first end of the actuator 52 may be as well. Notably, the first end of the actuator 52 and the push-button lens cap 24 need not be the same shape, as long as the connecting function between the two is facilitated. As illustrated, one or more tabs 53 are located on the outside of the first end of the actuator 52 for use in securing the push-button lens cap 24 to the actuator 52.

The actuator 52 has a generally cylindrical main portion adapted to fit within the middle cavity 46 of the body 26. Preferably, three legs 54*a,b,c* extend downwardly from the periphery of the main portion of the actuator 52 in a direction opposite its first end. A pair of the legs 54*a*,54*c* are preferably located about 180 degrees apart. The third leg 54*b* is positioned there between. As illustrated, the third leg 54*b* is preferably located nearer one of the legs 54*c* than the other of the legs 54*a*.

The opposing legs 54*a*,54*c* each have a catch 56 extending outwardly therefrom. Preferably, each catch 56 extends in a direction generally radially out in a direction perpendicular to an axis extending through the actuator. Referring to FIG. 1, when the actuator 52 is positioned in the body 26, the legs 54*a,b,c* extend through the spaces between the stop segments 51 of the body 26. When so positioned, the catches 56 engage a lower rim of the body 26, preventing further upward movement of the actuator.

A foot 58 is located on the end of the third leg 54*b*. As described in more detail below, the foot 58 is adapted to engage a button of the electrical switch 34 for actuating the switch. As illustrated, the foot 58 extends radially inward from the third leg 54*b*.

A spring 60 is positioned inside of the body 26 and engages both the body 26 and the actuator 52. In a preferred embodiment, the spring 60 is a helical spring. A first end of the spring 60 rests against the top surface of the stop segments 51 of the body 26. The second end of the spring 60 is positioned within the actuator 52 and rests against a stop 61 therein. So arranged, the spring 60 has the natural tendency to urge the actuator 52 upwardly to the point where further upward travel is limited by the catches 56. The urging of the actuator 52 upwardly also urges the push-button lens cap 24 attached thereto upwardly. When pressed by a user, the push-button lens cap 24 moves the actuator 52 downwardly against the biasing force of the spring 60, compressing the spring.

Figure 4:
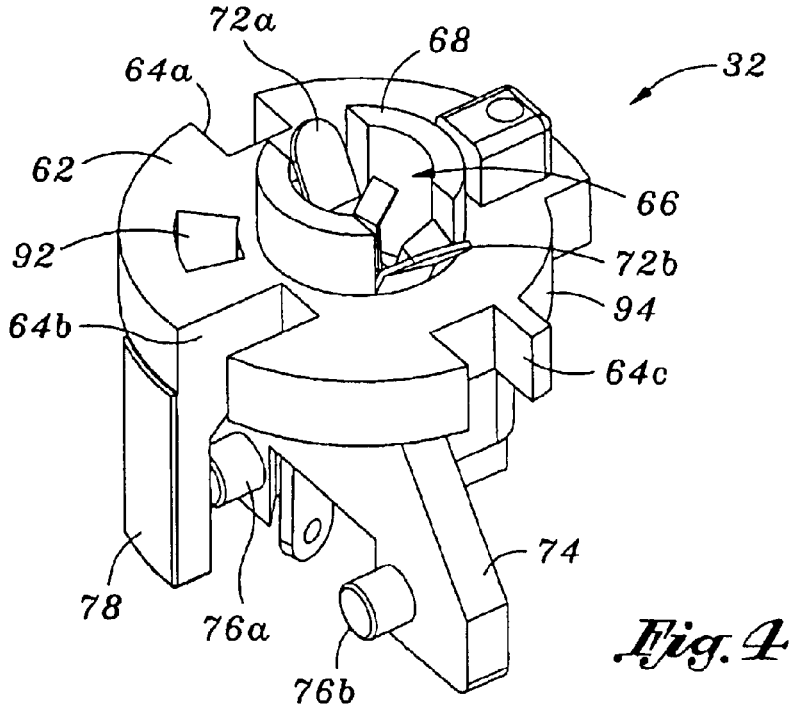
FIG. 4 is a perspective view of a lamp/switch mount of the push-button electrical switch of the invention.

The lamp/switch mount 32 is connected to the body 26 at its bottom end 38. The lamp/switch mount 32 will now be described in detail with reference to FIG. 4. The lamp/switch mount 32 has a generally disc-shaped main portion 62. The main portion 62 has three cut-out areas 64*a,b,c* permitting passage of the legs 54*a,b,c* of the actuator 52 therethrough.

A passage 66 extends generally centrally through (i.e., along a central axis extending generally perpendicular to a plane in which the main portion 62 extends) the main portion 62. A lamp stand 68 extends upwardly from a top surface of the main portion 62 and downwardly from a lower surface of the main portion, defining a generally lower closed end. In general, the lamp stand 68 forms extended portions of the passage 66 for accepting therein a bulb or lamp 70 (see FIG. 2), i.e. a lamp socket. First and second contacts 72*a,b* are also located in the passage 66. The first and second contacts 72*a,b* contact leads or contacts on the lamp 70. The contacts 72*a,b* extend through the lower closed end of the lamp stand 68 for connection to appropriate power wires for powering the lamp.

A switch mount 74 extends below the main portion 62 of the lamp/switch mount 32. The switch mount 74 is offset from the central axis. In one embodiment, the switch mount 74 extends from the lamp stand 68. The switch mount 74 includes first and second spaced pins 76*a,b*. A lock 78 extends downwardly from the main portion 62. The lock 78 is spaced apart from the pins 76*a,b*, defining a space in which the electrical switch 34 may be located.

Referring to FIG. 2, the electrical switch 34 has a generally closed housing 80. The electrical switch 34 may have a variety of shapes and configurations. As illustrated, the housing 80 is generally rectangular. First and second passages 82*a*,82*b* extend through the housing 80 from side to side. The passages 82*a,b* are adapted to accept the first and second pins 76*a*,76*b* of the lamp/switch mount 32.

A button 84 extends upwardly from a top surface of the housing 80. The button 84 preferably actuates an electrical switch within the electrical switch 34. In one embodiment, the electrical switch 34 is a two-position switch. The workings of such electrical switches 34 are well known. As is common in such a two-position electrical switch 34, the electrical switch 34 includes three leads or contacts 86*a,b,c*. The position of the electrical switch 34 determines which of the leads are "hot" (one being for ground).

Figure 5:
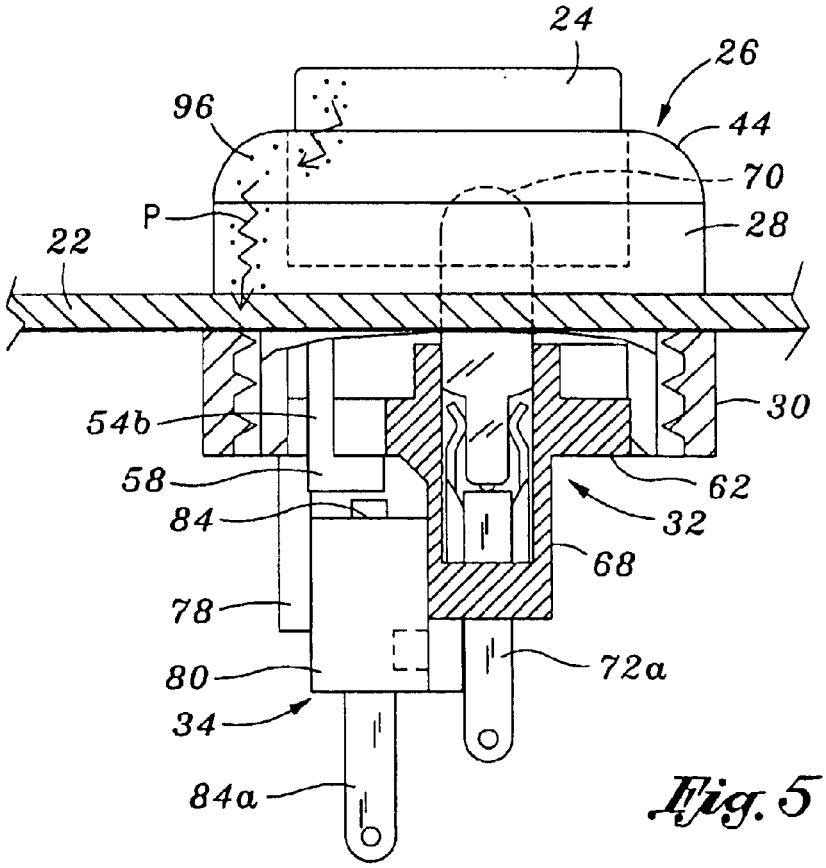
FIG. 5 is a cross-sectional view of the push-button electrical switch illustrated in FIG. 1 taken along a plane perpendicular to the support structure.

Referring to FIG. 5, when the electrical switch 34 is mounted to the lamp/switch mount 32 the pins 76*a,b* extend into the passages 82*a,b*. The lock 78 presses against the opposite side of the housing 80 of the electrical switch 34, maintaining the pins 76*a,b* in engagement with the passages 82*a,b*, securely mounting the electrical switch 34.

When so mounted, the foot 58 of the second leg 54*b* of the actuator 52 is positioned adjacent the button 84 of the electrical switch 34. When a user depresses the push-button lens cap 24, the actuator 52 is moved downwardly, causing the foot 58 to engage the switch button 84. This actuates the electrical switch 34.

Most importantly, in accordance with the invention there is provided an advantageous mounting arrangement for removably connecting the lamp/switch mount 32 to the body 26. Referring to FIGS. 3(*a*) and 3(*b*), first and second latches 88,90 extend from the bottom end 38 of the body 26. The latches 88,90 extend from the stop segments 51 of the body 26. Each latch 88,90 generally comprises a member extending outwardly from the stop segment and includes a catch. As illustrated, the latches 88,90 are positioned generally 180 degrees apart, with the catches facing generally in the same direction.

The lamp/switch mount 32 includes a passage 92 through the main portion 62. The passage 92 accepts the latch 90 therethrough. A cut-out or recess 94 is provided in the periphery of the main portion 62 of the lamp/switch mount 32.

Referring to FIG. 3(*a*), the lamp/switch mount 32 is arranged to be mounted in abutting relationship to the stop segments 51 at the bottom end 38 of the body 26. The top surface of the main portion 62 of the lamp/switch mount 32 is abutted against the lower surface of the stop segments 51 of the body 26. In this position, the latch 90 extends through the passage 92 in the lamp/switch mount 32, with the catch of the latch 90 engaging the lower portion of the main portion 62 of the lamp/switch mount 32. At the same time, the latch 88 extends along the cut-out area 94 in the main portion 62 of the lamp/switch mount 32, with the catch thereof also engaging the lower portion of the main portion 62 of the lamp/switch mount 32.

Preferably, as illustrated in FIG. 3(*a*), the latches 88,90 are arranged to press the lamp/switch mount 32 both upwardly against the stop segments 51, and radially outwardly against the inside wall of the body 26 at its bottom end 38. Importantly, the latches 88,90 are slightly flexible, permitting a user to bend them out of engagement with the lamp/switch mount 32, thereby permitting the lamp/switch mount 32 to be removed from engagement with the body 26.

In one or more other embodiments, other means may be provided for removably securing the lamp/switch mount 32 to the body 26. Preferably, the securing means includes at least one member which is accessible by a user for manipulation in unlocking or removing the lamp/switch mount 32 from the body 26. There may be only a single latch or more than one latch. The latch(es) may engage the lamp/switch mount 32 in a variety of manners. For example, the lamp/switch mount 32 need not include passages or cutout areas. The lamp/switch mount 32 may include a trough in the lower surface or in a side surface for engagement by a portion (such as a catch) of the latch(es). In one embodiment, a threaded rod may extend from the body 26 and through a passage/slot in the lamp/switch mount 32. A nut may be threaded onto the rod to engage the lamp/switch mount 32 with the body 26.

In one embodiment, the latches 88,90 may extend form the wall forming the body 26 instead of or in addition to the stop segments 51. In another embodiment, rotating lock members may be associated with the body 26 and moved into a locking position when the lamp/switch mount 32 is pressed into engagement therewith, and rotated out of the locking position to permit removal/disconnection of the lamp/switch mount 32 from the body 26. In general, it is desired that a release for the locking mechanism be accessible to the user.

The various components of the push-button electrical switch 20 may be constructed from a wide range of materials. In one embodiment, the push-button lens cap 24, actuator 52, body 26, adapter 28, lock nut 30, and lamp/switch mount 32 comprise plastic or a similar material conveniently constructed in a molding or extrusion process. The contacts 72*a*,72*b* and spring 60 preferably comprise metal members. In one or more embodiments, the various components may have a variety of colors.

In one embodiment of the invention, at least a portion of the body 26 around the push-button lens cap 24 is arranged to illuminate or be illuminated. In this manner, the location of the push-button lens cap 24 may be easily identified by a user. In a preferred embodiment, the body 26 is constructed from a transparent or generally transparent material, such as clear plastic, instead of traditional black polypropylene. Light emitted by the lamp 70 passes through the body 26, thereby illuminating the body 26, including the peripheral portion thereof at the top end 36 around the push-button lens cap 24.

In one embodiment, to provide significant contrast between the push-button lens cap 24 and the body 26, the push-button lens cap 24 is arranged to generally not transmit light emitted by the lamp 70. In one embodiment, the push-button lens cap 24 may be constructed of an opaque material. In another embodiment, a shield, such as plastic plate, may be located within the push-button lens cap 24. In this embodiment, the push-button lens cap 24 is generally not illuminated, but the surrounding body 26 is, whereby the illuminated body 26 generally serves to identify the extent/location of the push-button lens cap 24. In a preferred embodiment, as illustrated in FIG. 2, a legend plate 96 is located inside of the push-button lens cap 24. The legend plate 96 may have lettering printed thereon which is readable through the push-button lens cap 24. For example, the legend plate 96 may be printed with "deal/draw," "bet one" or other words, numbers or symbols. In one embodiment, the legend plate 96 permits light illuminated by the lamp 70 to pass therethrough to render the lettering or other printing more visible. For example, the legend plate 96 may be a plastic plate of any of a variety of colors (even clear) having printing, such as black or other colored lettering.

In accordance with another aspect of the invention, the push-button electrical switch 20 is arranged to divert or ground electrostatic discharge (ESD). In one or more embodiments of the invention, one or more of the components of the push-button electrical switch 20 are adapted to conduct electrical energy to the housing 22 of the gaming machine or other support structure or remote location, and away from the circuitry of the lamp 70 and electrical switch 34.

In one embodiment, as illustrated in FIG. 5, a path of electrical conduction P is defined from an external portion of the push-button electrical switch 20 to the housing 22 or other grounding element. In one or more embodiments, this pathway is defined by an electrically conductive material located in the push-button electrical switch 20. In one embodiment, the body 26, adapter 28, and/or lock nut 30 are constructed from plastic having a conductive carbon material 96 interspersed therein (see FIGS. 3A and 5). The interspersed conductive carbon 96 defines a pathway through the component to the housing 22 or other ground. Preferably, sufficient conductive carbon is provided that the path of least resistence to the electrical energy is defined through the component to ground rather than through the component to the electrical switch 34 or lamp 70, and thereon to the associated circuitry.

It will be appreciated that in order to provide an effective pathway P to ground, the housing 22 or other supporting structure may need to be specially configured. In one embodiment, the housing 22 may comprise a metal panel which is painted (such as powder coated). In such an embodiment, it is preferred that an area of contact be provided between the body 26, adapter 28, lock nut 30 or other component of the push-button electrical switch 20 directly with the metal of the housing 22.

In one embodiment, a metal strip or the like maybe connected to the push-button electrical switch 20, such as sandwiched between the adapter 28 and housing 22 or lock nut 30 and housing 22, with the metal strip extending to ground.

In another embodiment, the pathway P through the push-button electrical switch 20 to ground may comprise other than dispersed particles 96. In one embodiment, a wire may be embedded in the body 26 and extend from a top outer surface thereof to an contact with ground, such as the interface with the housing 22. Other interspersed materials maybe used. An advantage of the interspersed material is that the location or proximity of the user's touch or approach to the push-button electrical switch 20 need not then coincide with a specific location of the path to ground (as in the case of an embedded wire), since multiple paths to ground are provided.

In other embodiments, a layer of conductive material may be located on the one or more components of the push-button electrical switch 20. For example, a thin layer of conductive metal may be deposited on the exterior of the body 26 and/or adapter 28.

In one embodiment, the push-button lens cap 24 may be conductive. In such event, it is desired that the actuator 52 be insulating so that electrical energy is transferred from the push-button lens cap 24 through the body 26 to ground, and not to the switch/lamp circuits.

Assembly and use of the push-button electrical switch 20 of the invention will now be described. Referring to FIG. 2, the lamp 70 is installed into the lamp/switch mount 32 along with the contacts 72*a,b*. The electrical switch 34 is connected to the lamp/switch mount 32.

The push-button lens cap 24 is connected to the actuator 52. The spring 60 is inserted into the top end 36 of the body 26 and the actuator 52 is guided over the top end of the spring. The actuator 52 is pressed downwardly, compressing the spring 60 until the catches 56 of the legs 54*a*,54*c* of the actuator 52 engage the bottom end 38 of the body 26.

The lamp/switch mount 32 is then connected to the body 26. As described above, the lamp/switch mount 32 is aligned with the legs 54*a,b,c* and latches 88,90 and is pressed upwardly. The legs 54*a,b,c* extend through the recesses 64*a,b,c* in the lamp/switch mount 32. The latch 90 extends through the passage 92, and the latch 88 extends along the cut-out 94. Upon further upward movement, the catches on the latches 88,90 extend over the bottom surface of the main portion 62 of the lamp/switch mount 32, locking it to the body 26.

The push-button electrical switch 20 may be conveniently mounted to the housing 22. First, the adapter 28 is extended over the bottom end 38 of the body 26 and is moved upwardly as far as possible. Next, the bottom end 38 of the body 26 is passed through an aperture in the housing 22 until the adapter 28 rests upon or abuts the housing 22. The locking nut 30 is then engaged with the threads on the outer surface of the body 26 from the bottom end 38. The locking nut 30 is threaded upwardly until it engages the housing 22.

Appropriate wiring (not shown) is attached to the contacts 72*a*,72*b* for providing power to the lamp 70. Appropriate wiring (not shown) is also attached to the leads 86*a,b,c* of the electrical switch 34.

In use, a user depresses the push-button lens cap 24. The push-button lens cap 24 moves the actuator 52 downwardly against the force of the spring 60. Sufficient downward movement causes the foot 58 of the leg 54*b* to engage the switch button 84, actuating the electrical switch 34. Upon release of the user-applied pressure or force, the spring 60 moves the actuator 52 and push-button lens cap 24 upwardly.

A significant advantage of the push-button electrical switch 20 is that an electro-static discharge (ESD) from the player is routed away from the circuitry of the push-button electrical switch 20, avoiding many problems. In accordance with the invention, when a player touches (or comes sufficiently close to the push-button electrical switch 20 that a discharge may arc through the air space and bridge to the switch) the push-button electrical switch 20, the discharged electrical energy is routed to the housing 22 or a remote location, grounding the discharge. In the preferred embodiment, the discharge is routed through the conductive material in the body 26, adapter 28 and/or lock nut 30 to the housing 22. This path routes the electrical energy away from the lamp circuit or the switch circuit.

In accordance with the invention, a push-button electrical switch 20 is provided which is simple to assemble and disassemble. In particular, replacement of the lamp 70 is facilitated. In the event the lamp 70 burns out and needs replacing, the lamp/switch mount 32 is easily disengaged from the body 26, providing access to the lamp 70 for replacement. In order to disengage the lamp/switch mount 32, a user need only bias the catches of the latches 88,90 out of engagement with the lamp/switch mount 32. Then, the user may move the lamp/switch mount 32 downwardly with respect to the body 26 for access to the lamp 70.

As another aspect of the invention, the push-button electrical switch 20 has an illuminated body 26 surrounding the user-actuatable push-button lens cap 24. The illuminated body 26 aids in defining to a user the location of the push-button lens cap 24.

Another aspect of the invention will be described primarily with reference to FIGS. 6 and 7. In accordance with this embodiment of the invention, a tool 100 is provided for removing the lens cap 24 of the push-button electrical switch 20 and for removing and replacing the lamp 70.

Figure 6:
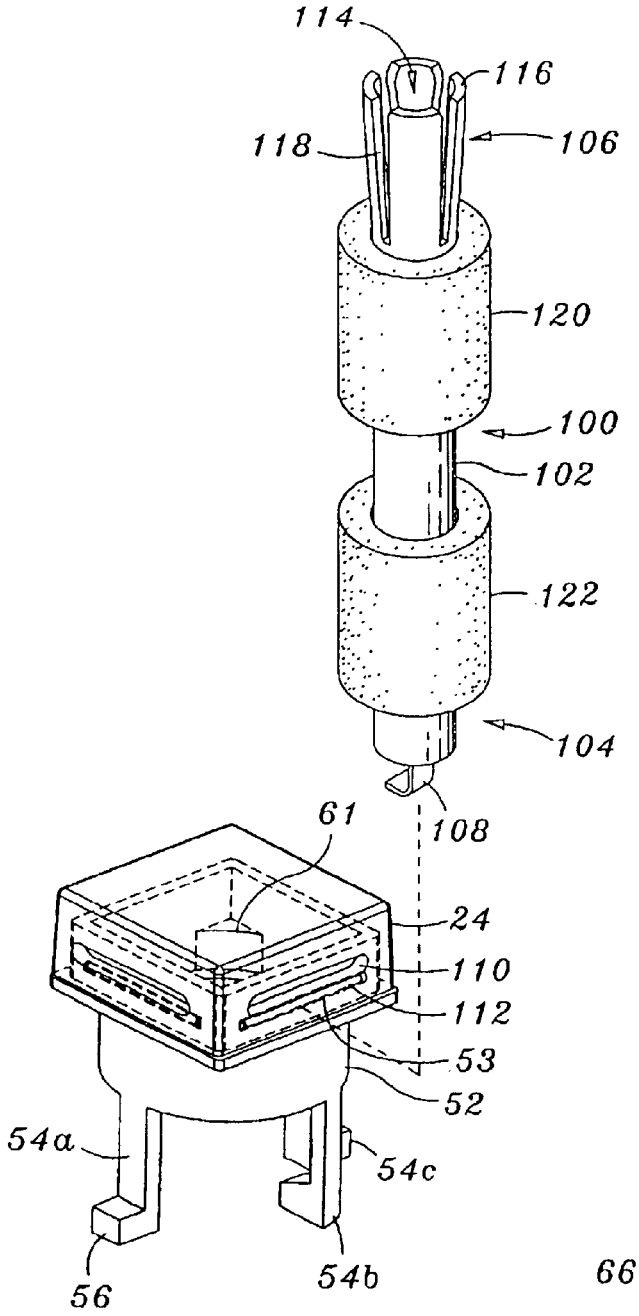
FIG. 6 illustrates a tool in accordance with the invention utilized to remove a lens cap in accordance with an embodiment of the invention.

Referring first to FIG. 6, the tool 100 has a body 102. As illustrated, the body 102 is generally rod or cylinder shaped. The body 102 may have a variety of shapes. The body 102 may be constructed of a variety of materials. In a preferred embodiment, the body 102 is constructed of metal, such as brass. Other materials, such as stainless steel and plastic, may be used.

The body 102 has a first end 104 and a second end 106. In one embodiment, the first end 104 includes a means for removing the lens cap or cover 24. As illustrated, this means comprises a prong, blade or head 108. The head 108 has a first end connected to the body 102, and a second end positioned outwardly from the body 102 for engaging the lens cap 24. As illustrated, the head 108 is curved, with the second end oriented at generally a ninety (90) degree angle with respect to the first end. The head 108 may have other shapes. For example, the head 108 may extend outwardly from the body 102 generally parallel to the body 102 along an axis therethrough, or the head 108 may be straight but extend outwardly from the body 102 at an angle.

In general, the second end of the head 108 is generally thin, having a thickness much less than its width. The head 108 is preferably sufficiently rigid to withstand the amount of force necessary to remove the lens cap 24 without deforming or breaking. The head 108 may be constructed of a variety of materials, and is preferably constructed of metal.

Preferably, the head 108 is sized to engage a notch 110 formed in the exterior of the lens cap 24. As illustrated in FIGS. 2 and 6, the lens cap 24 is preferably formed with one or more notches 110 located in the exterior thereof. In the embodiment illustrated, notches 110 are formed in all four sides of the lens cap 24. In other embodiments, notches 110 may be formed in fewer of the sides.

In one embodiment, each notch 110 comprises a recessed area in the surface of the lens cap 24. The notch 110 may be formed when the lens cap 24 is molded or may be machined into the surface of the lens cap 24. Though the notch 110 may extend entirely through the lens cap 24, it is preferably formed only in the surface. In this manner, no passages are formed in the lens cap 24 which would permit dirt, liquid or the like to pass into the interior of the push-button switch.

As illustrated, each notch 110 is formed as an elongate slot in the lens cap 24. Each notch 110 is preferably located on the lens cap 24 in a position where the notch 110 is accessible when the push-button electrical switch 20 is assembled. In particular, each notch 110 is located a sufficient distance vertically above the bottom edge of the lens cap 24 so that it is accessible above the top of the body 26. It is desired, however, that each notch 110 be located close to the body 26 when the push-button electrical switch 20 is assembled so that the notch 110 is not so apparently visible to the user of the push-button electrical switch 20.

In this configuration, it will be appreciated that the size of the head 108 of the tool 100 is selected so that it will engage the notch 110, both when considering the height and width of the notch 110. Preferably, the height of the notch 110 is slightly greater than the thickness of the head 108. In addition, it will be appreciated that the depth of the notch 110 is preferably sufficient to permit the head 108 to be located in and engage the notch 110 with sufficient security to permit application of force to the lens cap 24 via the head 108 to permit removal of the lens cap 24.

In use, a user engages the head 108 of the tool 100 with one of the notches 110 in the lens cap 24. The user applies an upward force to the tool 100, and thus the lens cap 24. This force removes the lens cap 24 from the actuator 52. In another embodiment, the user may locate the head 108 of the tool 100 under or along a lower edge of the lens cap 24. Upward force pries the lens cap 24 from the push-button switch.

As described, the actuator 52 may include tabs 53. These tabs 53 engage mating tabs 112 located on the interior of the lens cap 24. Downward force causes the tabs 112 on the lens cap 24 to move past the tabs 53 on the actuator 52, locking the lens cap to the actuator. Upward force applied by the tool 100 releases the tabs 112 on the lens cap 24 from the tabs 53 on the actuator 52. Of course, the lens cap 24 may engage the actuator 52 in other manners, and the tool 100 may similarly be used to disengage the lens cap 24.

Once the lens cap 24 is removed, it may be replaced with another lens cap 24, such as in the case of damage. In addition, the interior of the push-button switch 20 is accessible, including the lamp 70.

Figure 7:
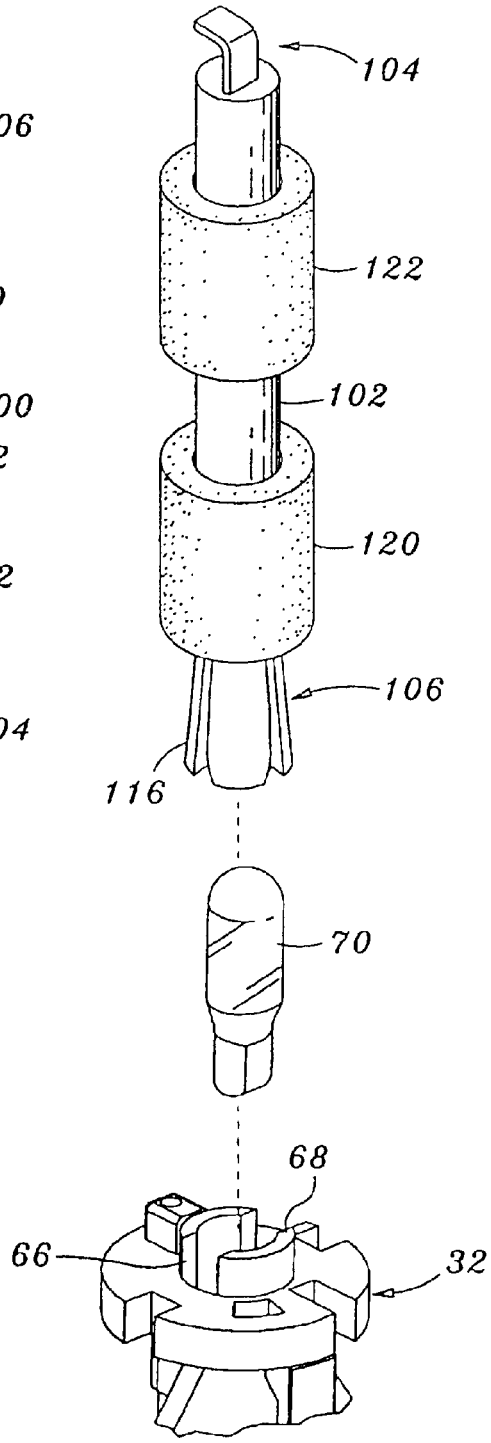
FIG. 7 illustrates the tool of FIG. 6 utilized to remove a bulb of the push-button electrical switch of the invention.

Referring to FIG. 7, the tool 100 is preferably also configured for use in removing the bulb or lamp 70. As illustrated, the second end 106 of the tool 100 is formed as a sleeve, thus defining a bulb-accepting opening or passage 114. In a preferred embodiment, the space or passage 114 is defined at least in part by a plurality of tines 116 comprising the second end 106 of the tool 100. The tines 116 are separated by longitudinal slots 118, permitting the tines 116 to move independently of one another.

In the embodiment illustrated, the tines 116 and slots 118 extend parallel to the body 102 of the tool. As illustrated, the tines 116 comprise a portion of the body 102, but they may be separate elements connected to the body 102.

The number of tines 116 and their configuration may vary. As illustrated, four tines 116 are provided. There may be as few as two or three or more than four.

In their resting or unbiased position, the tines 116 preferably extend radially outward from the body 102 of the tool 100. In the embodiment illustrated, each tine 116 has a first end which is connected to the body 102 and a second free end. The second or free end of the tine 116 is located radially outward of the first end. In this position, the opening or passage 114 is large enough to accept a bulb 70, as illustrated in FIG. 7.

The tines 116 may be moved inwardly, thus reducing the size of the opening or passage 114 and engaging a bulb. In one embodiment, the tool 100 preferably includes means for biasing the tines 116 into a position in which they engage the bulb 70. As illustrated, a slider 120 is mounted on the exterior of the body 102 of the tool 100. The slider 120 comprises a cylinder or sleeve which is movable along the tool 100.

In one embodiment, a stop 122 is located on the body 102 towards the first end 104. As illustrated, the stop 122 also serves as a handle when the first end of the tool 100 is being used to remove a lens cap 24. As such, the stop 122 comprises a member of increased radial dimension for gripping by a user. The stop 122 may have a variety of other shapes and sizes, including as the form of a tab or ridge extending around the body 102. The stop 122 limits the travel of the slider 120 along the body 102 in the direction of the first end 104.

When the slider 120 is in a retracted position, as illustrated in FIGS. 6 and 7, the tines 116 are in their unbiased or resting position. The slider 120 may be moved, however, to a position in which it extends over and engages the tines 116. In such a position, the slider 120 compresses the tines 116 inwardly. Thus, the slider 120 preferably has an interior dimension sized to permit it to travel over the main part of the body 102, but engage at least a portion of the tines 116 which extend radially outwardly.

A user may utilize the tool 100 to remove and replace a bulb 70. Once the lens cap 24 (if any) is removed, the user locates the sleeved second end 116 of the tool 100 over the bulb 70. The user then moves the slider 120 downwardly along the body 102 over the tines 116. This causes the tines 116 to be pressed inwardly against the bulb 70, gripping it. The user may then pull the bulb 70 out of the socket.

The user may replace a bulb, such as a burned out or broken bulb, by removing it and replacing the bulb with a new one. The new bulb may be installed by located it in the tines 116, locking it into place with the slider 120, and then pressing the bulb into the socket 68.

The configuration of the push-button electrical switch 20 and the tool 100 of the invention has numerous advantages. In the prior art, replacement of the bulb required, as in the case of an installation such as that illustrated in FIG. 5, access to the bulb mount. As illustrated, the bulb mount may be located under the mounting surface, such as a metal panel. Access to the underside of the mounting panel may be difficult. For example, if the mounting panel comprises a metal wall of a gaming machine, access to the underside requires access to the interior of the gaming machine. In order to prevent tampering and to comply with gaming laws, this may require that only particular authorized personnel open the gaming machine. Thus, maintenance of the machine may be delayed or may be expensive.

Of course, the tool of the invention may have a variety of alternate configurations. First, more than one tool may provide the functionality described. For example, one tool may have the prong and a second, separate tool the bulb-engaging sleeve. The orientation of the head and sleeve may vary. For example, the tool may be "L"-shaped and have these components at the ends thereof. The head and sleeve may be detachable from the body of the tool. For example, the tool body may define a housing or space at each end. The head may be connected to a shaft which in one position is connected to the body so that the head is located inside the space, and in another where the position of the shaft is reversed and connected to the body so that the head is accessible. The sleeve may similarly be connected to a separate element which can be connected to the body.

The head of the tool may be retractable. For example, the head may be connected to a button which may be moved linearly, permitting the head to be retracted into a space within the body or extended outwardly therefrom for use.

The tool of the invention could also be configured to engage more than one portion of the lens cap. For example, a first end of the tool could be configured as a pair of movable calipers each having a head for engaging notches on opposing sides of the lens cap.

The lens cap may also include a feature other than a notch for engagement with a tool or other element in application of force to remove it. For example, a rib or ridge could extend outwardly from the outside of the lens cap. The head of the tool could then be positioned under the rib or ridge and the upward force be applied to the rib or ridge. This embodiment has the disadvantage, however, that the rib or ridge may interfere with the normal travel of the button up and down with respect to the body of the push-button switch.

The configuration of the tines may also vary. For example, the tines could be mounted for rotation relative to the body in a can-type configuration. When rotated to one position, the tines might ride over an enlarged portion of the body, forcing them outward. When rotated to a second position, the tines may then retract.

Figure 8:
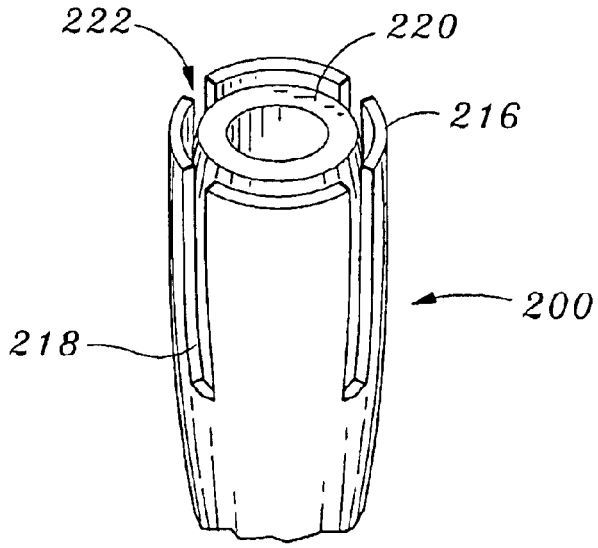
FIG. 8 is a perspective view of an end of another embodiment of a lamp removal tool in accordance with the invention.
Figure 9:
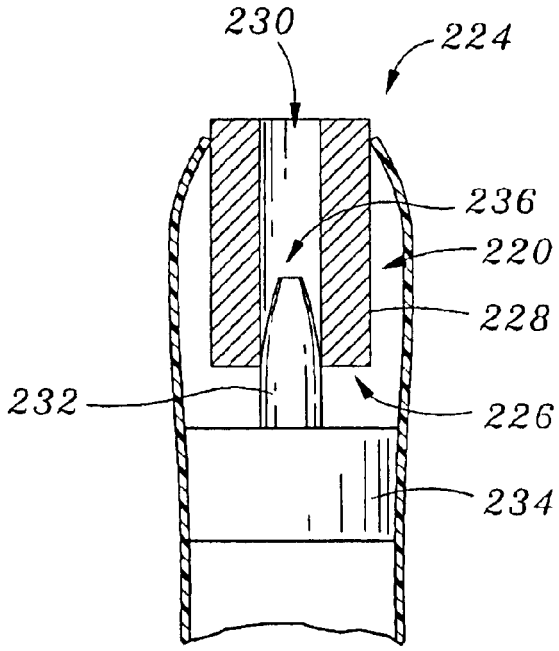
FIG. 9 is a cross-sectional side view of the lamp removal tool illustrated in FIG. 8.

Another embodiment of a tool 200 of the invention is illustrated in FIGS. 8 and 9. As illustrated in FIG. 8, a lamp removal tool 200 once again has an end which is defined by a plurality of tines 216. As illustrated, four tines 216 are separated by slots 218. The tines 216 may move inwardly and outwardly as described above. The tines 216 surround and define an open end 222 of the tool.

As illustrated, a sleeve 220 is located in the hollow open end 222 of the lamp removal tool 200. The sleeve 220 is preferably a soft, high-friction member for engaging a bulb. In one embodiment, the sleeve 220 is constructed of rubber or foam, and thus is compressible and/or flexible.

In one embodiment, the sleeve 220 has a generally cylindrical shape. Referring to FIG. 9, the sleeve 220 has a first end 224 and a second end 226. The sleeve 220 is defined by a wall 228 which has outer surface and an inner surface. The inner surface of the wall 228 defines an opening or passage 230. Preferably, cross-sectional dimension of the passage 230 is at least slightly greater than the cross-sectional dimension of a bulb to be used with the tool 200.

As illustrated, in one embodiment, the sleeve 220 is mounted to a rod 232. The rod 232 is connected to the tool 200, such as via a base 234. As illustrated, the base 234 is a body which is mounted within the tool 200 and which is secured thereto. The base 234 may comprise a molded plastic member which is press fit into the tool 200.

In one embodiment, the rod 232 is a generally cylindrical member which extends from the base 234. At least a portion of the rod 232 is configured to fit within the passage 230 through the sleeve 220 As illustrated, a free or top end 236 of the rod 232 may be tapered to aid guiding the sleeve 220 onto the rod 232.

The rod 232 may also serve as a stop. Preferably, the rod 232 extends into the passage 230 of the sleeve 220 a distance which, as described below, limits the distance by which a bulb may be extended into the sleeve 220 from the first end 224 thereof.

The tool 200 may be utilized to remove a bulb, such as from a push-button switch. Once the lens cap or other covering is removed, the end of the tool 200 is slipped over the bulb. In so doing, the sleeve 220 is extended over the bulb. The distance by which the tool 200 may be extended over the bulb is preferably limited, in that after a short distance the top of the bulb hits the end 236 of the rod 232. At that time, the user knows that the tool 200 is properly engaging the bulb. Notably, because the passage 230 in the sleeve 220 is larger than the bulb, the sleeve 220 slips over the bulb very easily.

Next, the user presses inwardly on one or more of the tines 216. The tines 216, in turn, press upon the sleeve 220, compressing it firmly against the bulb located in the passage 230. In this fashion, the bulb is gripped by the sleeve 220. The user can then pull upwardly or outwardly on the tool to remove the bulb from the socket. As indicated, an advantage of the sleeve 220 being constructed of a high friction material is that it aids in gripping the bulb during the removal process.

Once the bulb is removed from the push-button switch, it may be removed from the sleeve 220 by releasing the tines 216 and then pulling the bulb from the sleeve or allowing it to fall out of the passage 230. The old bulb may then be discarded.

The user may replace a bulb by first inserting an new bulb into the sleeve 220. The user then presses upon the tines 216 to ensure that the bulb does not fall from the sleeve. The user then aligns the new bulb with the socket of the push-button switch. The user presses the bulb downwardly into the socket. Notably, because the bulb is prevented from traveling into the sleeve 220 by the rod 232, when the user presses downwardly upon the tool 200, the bulb is likewise pressed downwardly into the socket.

Once the new bulb is located in the socket, the use releases the tines 216 and pulls upwardly on the tool 200, leaving the bulb in place.

It will be appreciated that the tool and the lens cap configuration may be applied to button switches having other configurations. The tool and lens cap configuration have particular utility with respect to push-button switches where the bulb or lamp is difficult to access, such as when connected to a gaming machine or similar housing and the bulb can otherwise only conveniently be removed by accessing the bottom portion of the push-button switch.

In accordance with the invention, the bulb may easily replaced from the top side of the push-button switch and the mount, such as gaming machine housing, to which it is connected. As described, the lens cap is removed and the bulb is easily extracted from the top of the push-button switch.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A tool for use in removing and replacing a bulb of a push-button type actuatable switch comprising:

a tool body, said tool body having a first end defining a bulb-accepting opening, said body defining a plurality of tines, each tine separated from each other tine by at least one slot, said tines defining at least a portion of said opening, a compressible bulb engaging insert located in said opening, said tines configured to move inwardly and outwardly to selectively compress said insert against a bulb positioned in said insert, said tines biased outwardly to a position in which said insert will accept said bulb; and a sleeve, said sleeve configured for movement between a first position in which said tines are permitted to move to their outward position and a second position in which said sleeve moves said tines inwardly and compress said insert against a bulb positioned in the insert.

2. The tool in accordance with claim 1 wherein said body defines four tines.

3. The tool in accordance with claim 1 wherein said sleeve comprises an annular member movably mounted on said body.

4. The tool in accordance with claim 1 wherein said body has a second end, said second end having projection extending therefrom, said projection configured to engage a lens cap extending over said bulb.

5. The tool in accordance with claim 4 wherein said projection comprises a prong.

6. The tool in accordance with claim 5 wherein at least a portion of said prong extends perpendicular to an axis extending through said body from said first end to said second end.

7. The tool in accordance with claim 1 wherein said body comprises a generally cylindrical wall defining a hollow interior, said tines formed from a portion of said wall.

8. The tool in accordance with claim 7 wherein said opening comprises at least a portion of said hollow interior.

9. The tool in accordance with claim 1 wherein said compressible insert comprises a sleeve defining a bulb-accepting opening.

10. The tool in accordance with claim 9 wherein said bulb-accepting opening in said sleeve comprises a passage extending through said sleeve, said passage having a first end and a second end, said first end facing outwardly for accepting a bulb and said second end located in said body of said tool, and including a stop, said stop extending into said passage from said second end thereof.

11. The tool in accordance with claim 10 wherein said stop has a base connected to said body of said tool and a rod extending outwardly therefrom, at least a portion of said rod located in said passage through said sleeve.

12. The tool in accordance with claim 11 wherein said rod has a free end positioned outwardly from said base, said free end having reduced outer dimension compared to the portion of said rod connected to said base.

13. A tool for use in removing and replacing a bulb of a push-button type actuatable switch comprising:

a tool body, said tool body having a plurality of tines located at a first end thereof, each tine separated from each other tine by at least one slot, said tines defining an opening, a compressible bulb engaging insert located in said opening, said insert defining a bulb-accepting opening, said tines biased away from said insert into a first position and said tines selectively movable inwardly into a second position in which said tines compress said insert whereby said insert will securely engage a bulb positioned in said insert;

a bulb stop, at least a portion of said stop located in said bulb-accepting opening of said insert, said stop configured to limit the depth a bulb may be inserted into said bulb-accepting opening; and a slider, said slider configured for sliding movement along said body between a first position in which said tines are located in their first position and a second position in which said slider presses said tines inwardly and said tines compress said insert against a bulb positioned in said bulb-accepting opening.

14. The tool in accordance with claim 13 wherein said body has a second end, said second end having projection extending therefrom, said projection configured to engage a lens cap extending over said bulb.

15. The tool in accordance with claim 14 wherein said projection comprises a prong.

16. The tool in accordance with claim 15 wherein at least a portion of said prong extends perpendicular to an axis extending through said body from said first end to said second end.

17. The tool in accordance with claim 13 wherein said body comprises a generally cylindrical wall defining a hollow interior, said tines formed from a portion of said wall.

* * * * *